US012588753B2

(12) United States Patent
Zhang

(10) Patent No.: US 12,588,753 B2
(45) Date of Patent: Mar. 31, 2026

(54) ELECTRIC HEIGHT ADJUSTABLE DESK

(71) Applicant: ZHEJIANG JIECANG LINEAR MOTION TECHNOLOGY CO., LTD., Shaoxing (CN)

(72) Inventor: Yajun Zhang, Shaoxing (CN)

(73) Assignee: ZHEJIANG JIECANG LINEAR MOTION TECHNOLOGY CO., LTD., Shaoxing (CN)

( * ) Notice: Subject to any disclaimer, the term of this patent is extended or adjusted under 35 U.S.C. 154(b) by 99 days.

(21) Appl. No.: 18/699,004

(22) PCT Filed: Jan. 10, 2023

(86) PCT No.: PCT/CN2023/071468

§ 371 (c)(1),
(2) Date: Apr. 5, 2024

(87) PCT Pub. No.: WO2023/165270

PCT Pub. Date: Sep. 7, 2023

(65) Prior Publication Data

US 2025/0234990 A1 Jul. 24, 2025

(30) Foreign Application Priority Data

Mar. 1, 2022 (CN) ..... 202220430654.8

(51) Int. Cl.
*A47B 9/00* (2006.01)

(52) U.S. Cl.
CPC ..... *A47B 9/00* (2013.01)

(58) Field of Classification Search
CPC ..... A47B 9/00; A47B 9/20
See application file for complete search history.

(56) References Cited

U.S. PATENT DOCUMENTS 10,405,646 B2 9/2019 Tseng et al.
2019/0125072 A1 5/2019 Tseng et al.
(Continued)

FOREIGN PATENT DOCUMENTS

CA 3 092 777 A1 9/2019
CN 108783887 A 11/2018
(Continued)

OTHER PUBLICATIONS

Jan. 30, 2025 Extended Search Report issued in European Patent Application No. 23762671.8.
(Continued)

*Primary Examiner* — Matthew W Ing
(74) *Attorney, Agent, or Firm* — OLIFF PLC.

(57) ABSTRACT

An electric height adjustable desk overcomes assembly cumbersomeness and inconvenience, optimizes product assembly structure and manner and facilitates assembly. The desk includes a frame and column, the frame including a crossbar and side board connected at each end of the crossbar, a column end portion with a chassis enclosure, an accommodation cavity on the crossbar, the chassis enclosure at least partially embedded in the accommodation cavity; a detachable first latch mechanism between the side board side surface and the chassis enclosure, the side board being detachably connected to the crossbar via the first latch mechanism; a detachable second latch mechanism is between the chassis enclosure and crossbar; a locking device is on the chassis enclosure, the locking device being locked on the crossbar to connect the first and second latch mechanism, the second latch mechanism is between the locking device and first latch mechanism.

7 Claims, 9 Drawing Sheets

(56) References Cited

U.S. PATENT DOCUMENTS

| | | | |
|---|---|---|---|
| 2021/0100355 | A1 | 4/2021 | Jørgensen |
| 2022/0287452 | A1 | 9/2022 | Jørgensen |

FOREIGN PATENT DOCUMENTS

| | | | | | |
|---|---|---|---|---|---|
| CN | 209202318 | U | * | 8/2019 | |
| CN | 110464122 | A | | 11/2019 | |
| CN | 111657667 | A | | 9/2020 | |
| CN | 212280392 | U | * | 1/2021 | ..... A47B 9/20 |
| CN | 113397301 | A | * | 9/2021 | ..... A47B 3/06 |
| CN | 217565255 | U | | 10/2022 | |
| DE | 202020105069 | U1 | | 12/2021 | |

OTHER PUBLICATIONS

Mar. 13, 2023 International Search Report issued in International Patent Application No. PCT/CN2023/071468.
Mar. 13, 2023 Written Opinion issued in International Patent Application No. PCT/CN2023/071468.

* cited by examiner

ELECTRIC HEIGHT ADJUSTABLE DESK

FIELD

The disclosure relates to electric height-adjustable desks, and more particularly relates to an electric height adjustable desk.

BACKGROUND

An existing electric height adjustable desk generally comprises a column, a frame, and a side board; the side board is connected to the frame at each of two sides of the frame, the column being disposed at each of two ends of the bottom of the frame so as to support the frame, where the column, the frame, and the side board are usually assembled via screws, the drawbacks of which are such that manual assembly of the height adjustable desk is cumbersome, inconvenient, and inefficient.

SUMMARY

An electric height adjustable desk is provided, which overcomes cumbersome and inconvenient assembly in conventional electric height adjustable desks.

An electric height adjustable desk according to the disclosure comprises: a frame and a column, the frame comprising a crossbar and a side board connected at each of two ends of the crossbar, an end portion of the column being provided with a chassis enclosure, an accommodation cavity being provided on the crossbar, the chassis enclosure being at least partially embedded in the accommodation cavity; a detachable first latch mechanism is provided between a side surface of the side board and the chassis enclosure, the side board being detachably connected to the crossbar via the first latch mechanism; a detachable second latch mechanism is provided between the chassis enclosure and the crossbar; a locking device is provided on the chassis enclosure, the locking device being locked on the crossbar to maintain a connected state between the first latch mechanism and the second latch mechanism, the second latch mechanism being disposed between the locking device and the first latch mechanism.

In the electric height adjustable desk, the first latch mechanism comprises a first journal, a first engaging groove, and a second engaging groove, the first engaging groove and the second engaging groove being snap-fitted with the first journal, respectively, the first journal being disposed on the side board, the first engaging groove being provided at one end of the crossbar, the second engaging groove being provided at one end of the chassis enclosure.

In the electric height adjustable desk, the second latch mechanism comprises a third engaging groove, and a second journal fitted with the third engaging groove, either one of the second journal and the third engaging groove being provided at an inner side of the crossbar, another one of the second journal and the third engaging groove being provided at a side surface of the chassis enclosure.

In the electric height adjustable desk, an opening direction of the first engaging groove is opposite to an opening direction of the second engaging groove, and the opening direction of the first engaging groove is consistent with an opening direction of the third engaging groove.

In the electric height adjustable desk, at least two second journals are provided, a plurality of the second journals being distributed, along a length direction of the crossbar, on the side surface of the chassis enclosure or at the inner side of the crossbar.

In the electric height adjustable desk, the locking device comprises a locking element and an unlocking element, the locking element being movably disposed on the chassis enclosure, the crossbar being provided with a socket insert-fitted with the locking element, the locking element being movable relative to the chassis enclosure into the socket to thereby lock the chassis enclosure to the crossbar, the unlocking element being configured to bring the locking element to move so as to be detached from the socket.

In the electric height adjustable desk, a cavity for accommodating the locking element is provided in the chassis enclosure, an elastic member configured to push the locking element through the chassis enclosure into the socket being provided in the cavity.

In the electric height adjustable desk, a guide rib configured to guide the locking element to move into the socket is provided in the chassis enclosure.

In the electric height adjustable desk, the unlocking element and the locking element are connected, the unlocking element being partially disposed outside the chassis enclosure so that the locking element is moved by the unlocking element from outside of the chassis enclosure.

In the electric height adjustable desk, an end portion of the crossbar is provided with a mounting groove opened upwards, the side board having a mounting lug embeddable in the mounting groove, the first journal being disposed on the mounting lug.

The disclosure offers the following benefits:

In the disclosure, the chassis enclosure is provided at an end portion of the column; the side board is detachably connected to the crossbar and the chassis enclosure via the first latch mechanism, respectively; in this way, the side board, the crossbar, and the chassis enclosure may be preliminarily fixed. The chassis enclosure and the crossbar are further connected via the second latch mechanism, so that the chassis enclosure may be limited and supported by the second latch mechanism. Moreover, the locking device disposed on the chassis enclosure further locks the chassis enclosure to the crossbar, which may maintain the connected state between the side board, the frame, and the chassis enclosure via the first latch mechanism, and the connected state between the crossbar and the chassis enclosure via the second latch mechanism. As such, the side board is synchronously limited while the chassis enclosure is fixed to the crossbar, which realizes synchronous fixation between the side board, the crossbar, and the chassis enclosure, thereby facilitating assembly of the electric height adjustable desk.

In the disclosure, the second latch mechanism is disposed between the first latch mechanism and the locking device, the chassis enclosure, when being accommodated in the accommodation cavity, is connected to the side board via the first latch mechanism, and the chassis enclosure and the crossbar are connected via the locking device, whereby the two ends of the chassis enclosure are limited. Meanwhile, the second latch mechanism is employed to connect the middle portion of the chassis enclosure to the crossbar, such that the two ends and the middle portion of the chassis enclosure are all fixed, which further enhances stability and pressure-bearing performance of the chassis enclosure, and provides a more stable connection between the side board, the crossbar, and the chassis enclosure.

In a further solution, the first latch mechanism comprises a first journal, a first engaging groove, and a second engaging groove, the first engaging groove and the second engaging groove being snap-fitted with the first journal, respectively, the first journal being disposed on the side board, the first engaging groove being provided at one end of the crossbar, the second engaging groove being provided at one end of the chassis enclosure. By snap-fitting the crossbar and the chassis enclosure with the first journal via the first engaging groove and the second engaging groove, respectively, combination and connection of the crossbar, the chassis enclosure, and the first journal are facilitated; meanwhile, to enable snap-fitting between the second engaging groove and the first journal, a corresponding opening end is provided in each engaging groove, so that after the second engaging groove is snap-fitted with the first journal, the chassis enclosure may be rotated, via the second engaging groove, into the accommodation cavity about the first journal as a point of rotation, which facilitates quick assembly of the chassis enclosure into the accommodation cavity; as such, the chassis enclosure, after being embedded in the accommodation cavity, is locked to the crossbar, and then the first latch mechanism and the second latch mechanism are deployed to maintain the connected state between the crossbar, the side board, and the chassis enclosure, rendering the assembly more convenient and reliable.

In a further solution, the second latch mechanism comprises a third engaging groove, and a second journal fitted with the third engaging groove, either one of the second journal and the third engaging groove being provided at an inner side of the crossbar, another one of the second journal and the third engaging groove being provided at a side surface of the chassis enclosure. The snap-fitted second journal and third engaging groove, which are respectively formed at the side surface of the chassis enclosure and the inner side of the crossbar, enable limitation to the rotating angle of the chassis enclosure after the chassis enclosure is snap-fitted with the first journal via the second engaging groove, and further enhance stability of the chassis enclosure mounted on the crossbar as well as pressure-bearing performance of the chassis enclosure after the two ends of the chassis enclosure are respectively fitted with the first journal via the second engaging groove and the locking device is insert-fitted to be locked with the frame.

In a further solution, an opening direction of the first engaging groove is opposite to an opening direction of the second engaging groove, and the opening direction of the first engaging groove is consistent with an opening direction of the third engaging groove. By setting the opening direction of the first engaging groove opposite to the opening direction of the second engaging groove, fitting of the crossbar and the side board with the first journal via the first engaging groove and the second engaging groove enables limitation to the moving direction of the first journal, which prevents the first journal from being detached from the position overlapping with the opening of the first engaging groove or the second engaging groove if the opening direction of the first engaging groove was set consistent with that of the second engaging groove. By setting the opening direction of the first engaging groove consistent with the opening direction of the third engaging groove, one end of the chassis enclosure and the side board are limited by the fitting between the second engaging groove and the first journal and the fitting between the second journal and the third engaging groove; since one end and the middle portion of the chassis enclosure being limited, at which time the chassis enclosure can only move towards the opening direction of the third engaging groove with the second journal as a supporting point and the first journal as a point of rotation, and after the chassis enclosure is locked to the crossbar via the locking device, the two ends and the middle portion of the chassis enclosure are all limited, so that the chassis enclosure is securely fixed in the accommodation cavity.

In a further solution, at least two second journals are provided, a plurality of the second journals being distributed, along a length direction of the crossbar, on the side surface of the chassis enclosure or at the inner side of the crossbar. The two horizontally arranged second journals can increase connection stability between the chassis enclosure and the crossbar via fitting between the third engaging groove and the second journal; this prevents the chassis enclosure from swaying after being embedded in the accommodation cavity, and enhances stability and pressure-bearing performance of the chassis enclosure in the crossbar.

In a further solution, the locking device comprises a locking element and an unlocking element, the locking element being movably disposed on the chassis enclosure, the crossbar being provided with a socket insert-fitted with the locking element, the locking element being movable relative to the chassis enclosure into the socket to thereby lock the chassis enclosure to the crossbar, the unlocking element being configured to bring the locking element to move so as to be detached from the socket. The locking element movably disposed on the chassis enclosure facilitates the chassis enclosure, after being mounted in the accommodation cavity, to be insert-fitted with the socket provided on the crossbar, thereby further limiting position of the chassis enclosure on the crossbar; while the unlocking element facilitates driving the locking element to be detached from the crossbar, thereby casily unlocking the insert-fitting between the chassis enclosure and the frame.

In a further solution, a cavity for accommodating the locking element is provided in the chassis enclosure, an elastic member configured to push the locking element through the chassis enclosure into the socket being provided in the cavity. Provision of the elastic element facilitates pushing the locking element out of the chassis enclosure so as to facilitate connection to the crossbar, which also facilitates squeezing the locking element to be detached from the socket.

In a further solution, a guide rib configured to guide the locking element to move into the socket is provided in the chassis enclosure. The guide rib is set to limit a movable range of the locking element in the chassis enclosure, so that the locking element, when moving inside the chassis enclosure, is guided to be accurately inserted into the socket on the crossbar.

In a further solution, the unlocking element and the locking element are connected, the unlocking element being partially disposed outside the chassis enclosure so that the locking element is moved by the unlocking element from outside of the chassis enclosure. Disposing the unlocking element outside the chassis enclosure facilitates adjusting the position of the unlocking element from outside of the chassis enclosure to drive the locking element to be separated from the socket, thereby implementing quick detachment of the chassis enclosure from the frame.

In a further solution, an end portion of the crossbar is provided with a mounting groove opened upwards, the side board having a mounting lug embeddable in the mounting groove, the first journal being disposed on the mounting lug. Embedding the mounting lug in an end portion of the crossbar facilitates connection between the side board and the end portion of the crossbar, which also facilitates concealment of the connecting structure between the side board and the crossbar, giving a more aesthetic appearance.

The above and other features and advantages of the disclosure will be described in detail below through specific example embodiments in conjunction with accompanying drawings.

BRIEF DESCRIPTION OF THE DRAWINGS

Hereinafter, the disclosure will be illustrated in further detail with reference to the accompanying drawings.

REFERENCE NUMERALS

Figure 1:
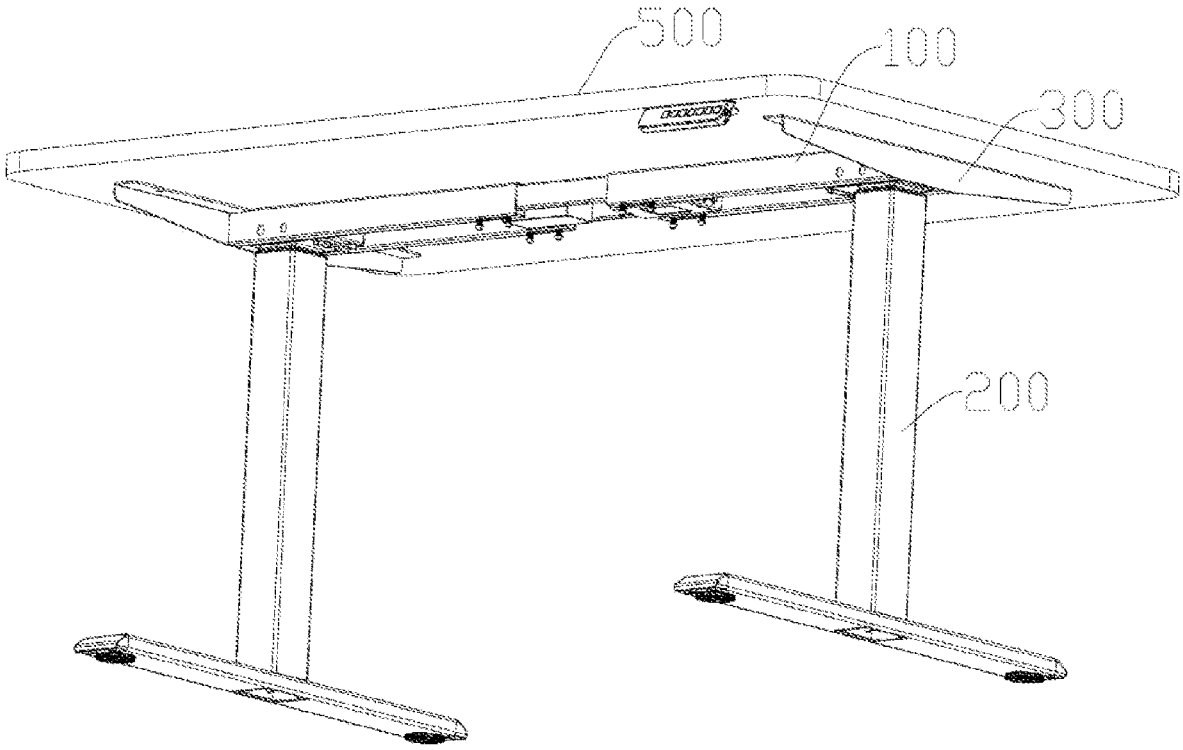
FIG. 1 is a structural schematic diagram according to some embodiments of the disclosure.

100 crossbar, 110 second journal, 120 first engaging groove, 130 socket, 140 mounting groove;

200 column

300 side board, 310 mounting lug, 311 first journal

400 chassis enclosure, 410 upper housing, 411 third engaging groove, 412 second engaging groove, 420 lower housing, 421 guide rib, 422 locking element, 4221 connecting end, 4222 insert-fitting end, 4223 unlocking element, 430 elastic member.

DETAILED DESCRIPTION OF EMBODIMENTS

Hereinafter, the technical solutions of the disclosure will be explained and illustrated through embodiments with reference to the accompanying drawings. However, the embodiments are only some embodiments of the disclosure, not all of them. Other embodiments obtained by those skilled in the art based on the examples in the embodiments without exercise of inventive work all fall within the protection scope of the disclosure.

In the description of the disclosure, it needs to be understood that the orientational or positional relationships indicated by the terms "center," "longitudinal," "transverse," "length," "width," "thickness", "upper," "lower," "front," "rear," "left," "right," "vertical," "horizontal," "top," "bottom," "inner," "clockwise," "counterclockwise," etc. are orientational and positional relationships based on the drawings, which are intended only for facilitating description of the disclosure and simplifying relevant illustrations, not for indicating or implying that the devices or elements compulsorily possess those specific orientations and are compulsorily configured and operated with those specific orientations; therefore, such terms should not be construed as limitations to the disclosure.

Besides, the terms "first" and "second" are only used for descriptive purposes, which shall not be construed as indicating or implying relative importance or implicitly indicating the amount of a referred to technical feature. Therefore, the features limited by "first" and "second" may explicitly or implicitly include one or more of such features. In the description of the disclosure, unless otherwise indicated, "plurality" indicates two or more.

In the disclosure, unless otherwise explicitly provided and limited, the terms such as "mount," "connect," "couple," and "fix" should be understood broadly, which, for example, may refer to a fixed connection, a detachable connection, or an integral connection; which may be a mechanical connection or an electrical connection; which may be a direct connection or an indirect connection via an intermediate medium; which may also be a communication between the insides of two elements. To a person of normal skill in the art, specific meanings of the above terms in the disclosure may be construed based on specific situations.

In the disclosure, unless otherwise explicitly provided and limited, an expression that a first feature is "above" or "below" a second feature may refer to a direct contact between the first feature and the second feature or may refer to a scenario where although the first feature and the second feature do not contact directly, they contact via a further feature therebetween. Moreover, the expression that the first feature is "above" or "over" or "on" the second feature refers to a situation where the first feature is exactly or generally over the second feature or only refers to a situation that the horizontal height of the first feature is higher than the second feature. The expression that the first feature is "under" or "below" or "beneath" the second feature refers to a situation where the first feature is exactly or generally below the second feature or only refers to a situation that the horizontal height of the first feature is lower than the second feature.

Figure 2:
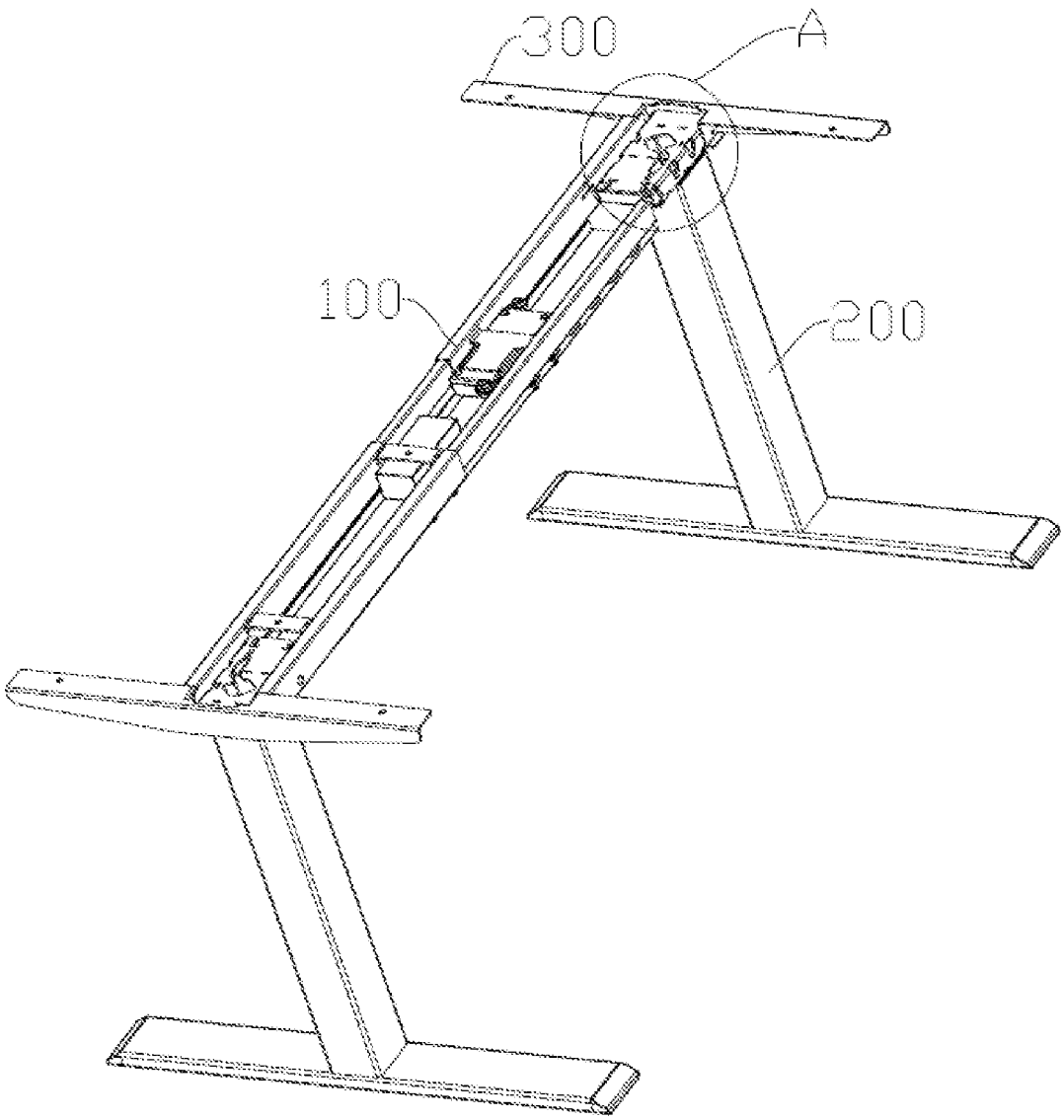
FIG. 2 is a structural schematic diagram according to some embodiments of the disclosure.
Figure 3:
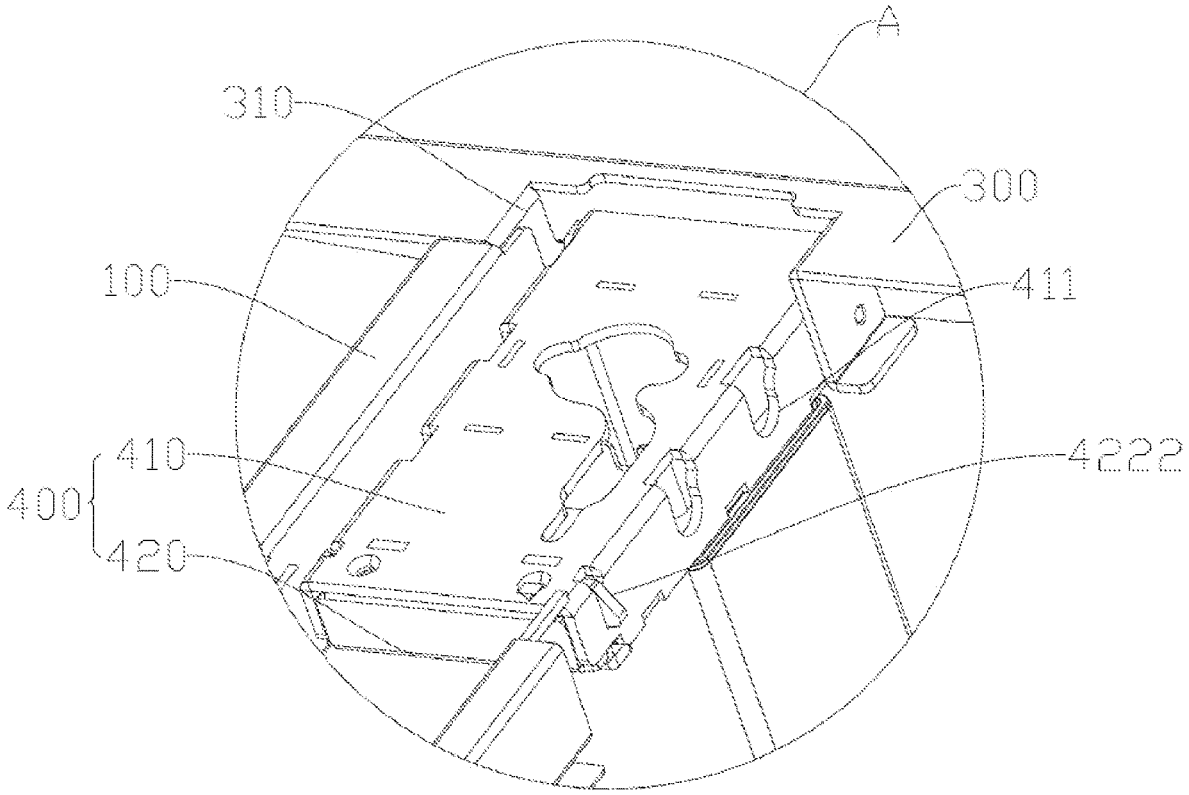
FIG. 3 is a structural schematic diagram of part A in FIG. 2 according to some embodiments of the disclosure.

Referring to FIGS. 1, 2 and 3, an electric height adjustable desk according to embodiments of the disclosure generally comprises: a column assembly, a frame, and a side board 300; the side board 300 is mounted at each of two ends of the frame, a desktop support of an "H"-like shape being formed between the side board 300 and the frame to mount a desktop; the frame generally includes two parallelly arranged crossbars 100, an accommodation cavity being formed between end portions of the two crossbars 100; the column assembly comprises a column 200 and a chassis enclosure 400 embeddable in the accommodation cavity; one end of the chassis enclosure 400 is connected to the side board 300 via a first latch mechanism, a first engaging groove 120 connected to the first latch mechanism being provided at an end portion of each crossbar 100, a side surface of the chassis enclosure 400 being connected to an inner side of the crossbar 100 via a second latch mechanism, while the other end of the chassis enclosure 400 being insert-fitted with the crossbar 100 via a locking device.

In this example embodiment, the first latch mechanism comprises a second engaging groove 412 disposed at a side surface of one end of the chassis enclosure 400, and a first journal 311 disposed at the side board 300; the second latch mechanism comprises a second journal 110 disposed at an inner side of the crossbar 100, and a third engaging groove 411 disposed at each of two sides of the chassis enclosure 400 and fitted with the second journal 110; the locking device comprises two locking elements 422 disposed at one end of the inside of the chassis enclosure 400 distant from the second engaging groove 412, and an unlocking element 4223 connected to the locking elements 422; the chassis enclosure 400 comprises an upper housing 410 and a lower housing 420, a cross section of the upper housing 410 having a U-shaped structure, a second engaging groove 412 being provided at the end of each of the two sides of the upper housing 410 proximal to the side board 300; a mounting lug 310 bent towards the inside of the crossbar 100 is provided in a middle portion of the side board 300, two first journals 311 being provided on the mounting lug 310; the locking element 422 movable on the chassis enclosure 400 is provided at one end of the chassis enclosure 400 distant from the second engaging groove 412, two locking elements 422 being provided; the ends of the two locking elements 422 disposed inside the chassis enclosure 400 are elastically loaded via an elastic member 430; through holes accommodating the locking elements 422 and configured for the locking elements 422 to pass through are provided at two sides of the chassis enclosure 400; the locking elements, when being elastically loaded by the elastic member 430, can project out of the through holes at the two sides of the chassis enclosure 400 and can be inserted into the sockets 130 provided in the inner side of the crossbar 100; an end portion of the crossbar 100 is provided with a first engaging groove 120 that may be snap-fitted with the first journal 311.

In this example embodiment, an electric motor for driving the column 200 to ascend and descend may be mounted on the column 200 or on the crossbar 100; the chassis enclosure 400 is configured to connect the column 200 to the crossbar 100 and the side board 300. It can be contemplated that if the chassis enclosure 400 is large enough, a corresponding actuator may also be directly mounted in the chassis enclosure 400.

Figure 9:
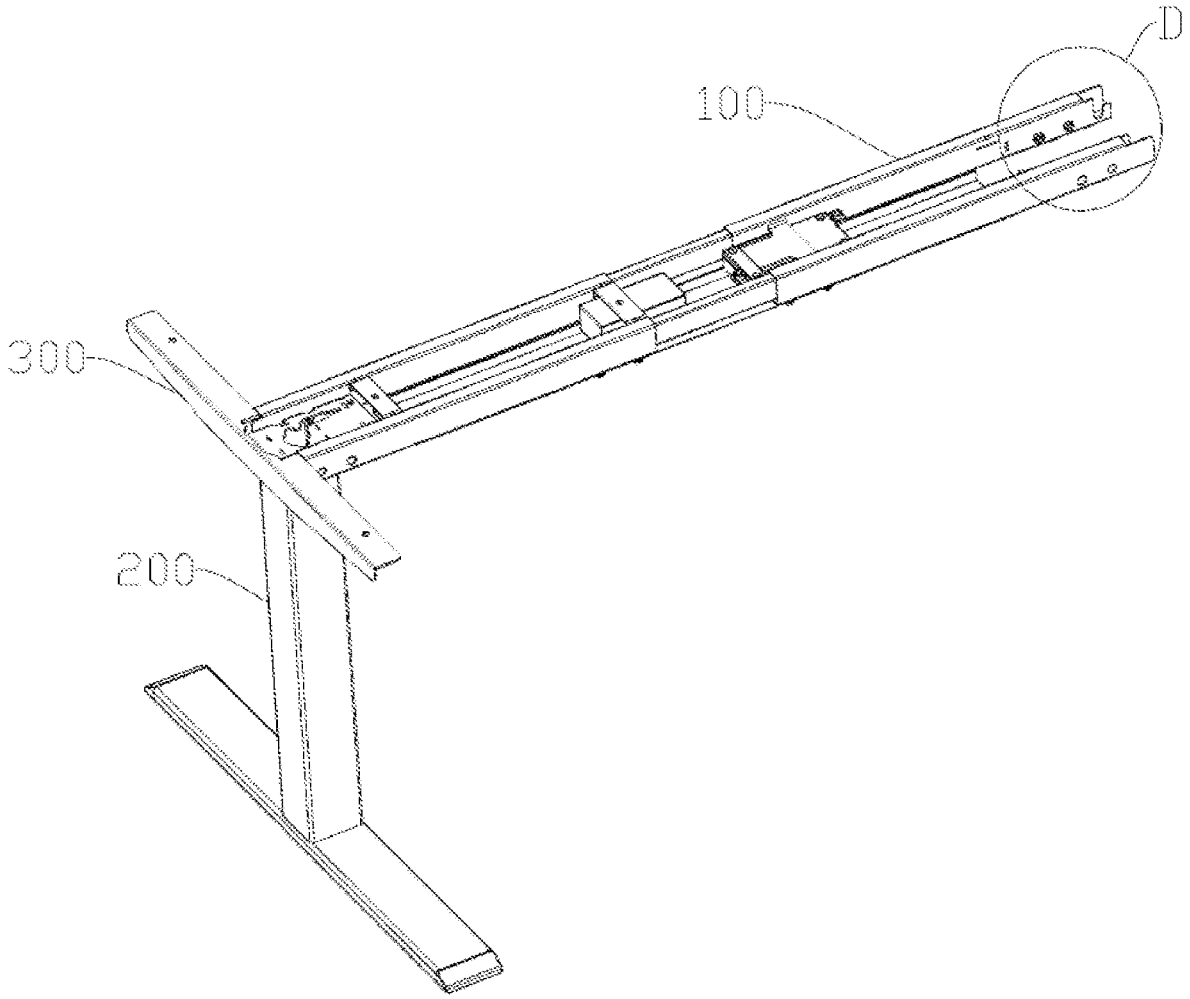
FIG. 9 is a structural schematic diagram of a frame in some embodiments of the disclosure.
Figure 10:
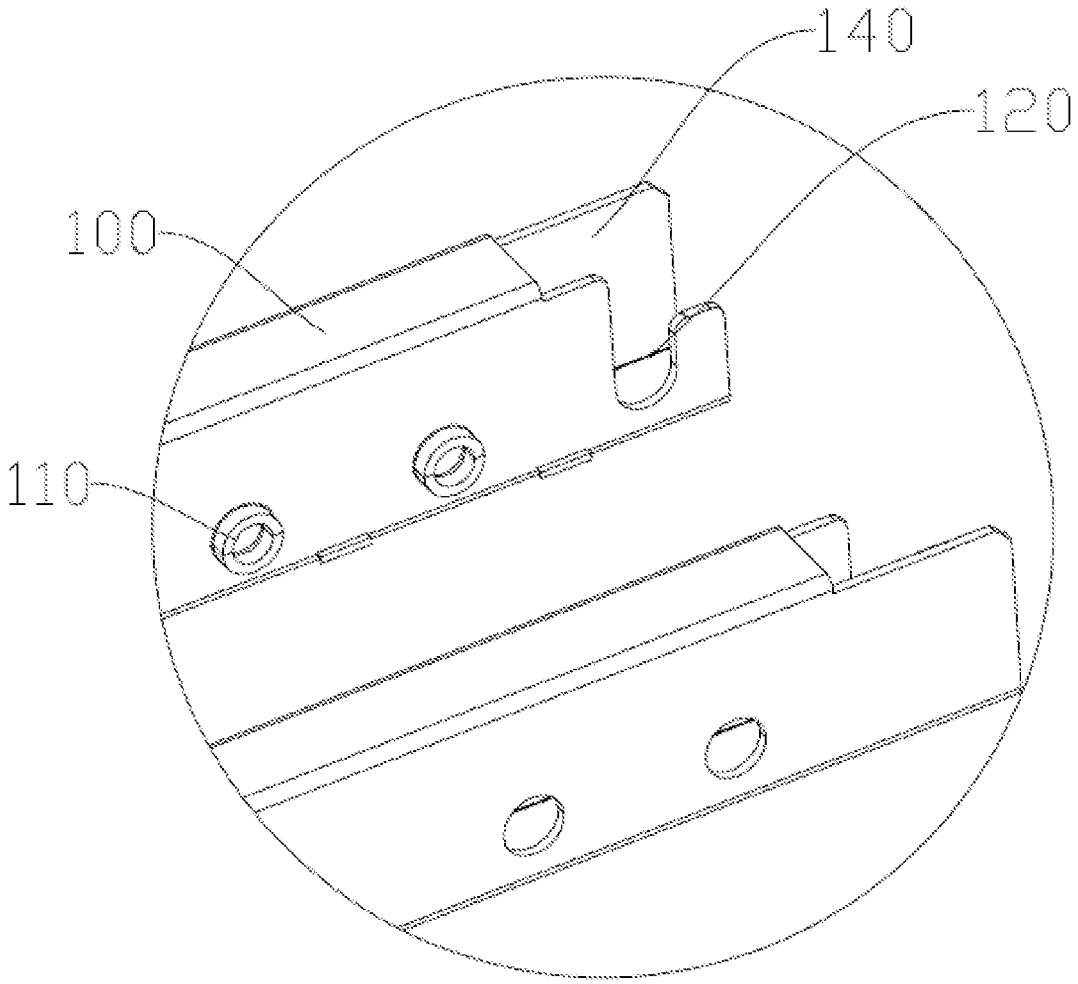
FIG. 10 is a structural schematic diagram of part D in FIG. 9 according to some embodiments of the disclosure.

In this example embodiment, referring to FIGS. 9 and 10, an end portion of the crossbar 100 is provided with a mounting groove 140 opened upwards; the first engaging groove 120 is formed at an inner side of the crossbar 100. When mounting the side board 300 with the crossbar 100, the mounting lug 310 is correspondingly embedded in the mounting groove 140, while the first journal 311 on the mounting lug 310 is correspondingly embedded in the first engaging groove 120; in this way, by embedding the mounting lug 310 into the mounting groove 140, quick connection between the side board and the crossbar 100 can be realized; meanwhile, the mounting lug 310 is also concealed inside the mounting groove 140 of the crossbar 100, which optimizes product structure and reduces exposure of the connecting structure to render a more aesthetic appearance.

In this example, a third engaging groove 411 is provided at each of the two sides the chassis enclosure 400 in the middle, while a second journal 110 corresponding to the third engaging groove 411 is provided at the inner side of the crossbar 100; an opening direction of the third engaging groove 411 is consistent with that of the first engaging groove 120 but opposite to the opening direction of the second engaging groove 412 at the end portion of the chassis enclosure 400. In this way, when the chassis enclosure 400 is embedded in the accommodation cavity about the first journal 311, the third engaging groove 411 on the chassis enclosure 400 is smoothly snap-fitted in the second journal 110; meanwhile, since the opening direction of the third engaging groove 411 is opposite to that of the second engaging groove 412, the chassis enclosure 400, when being embedded into the accommodation cavity, can only move towards the opening direction of the third engaging groove 411 with the second journal 110 as a supporting point and the first journal 311 as a point of rotation. After the chassis enclosure 400 is insert-fitted and locked with the crossbar 100 via the locking element 422, the two ends and the middle portion of the chassis enclosure 400 are all limited, so that the chassis enclosure 400 is securely fixed in the accommodation cavity, whereby the side board 300, the crossbar 100, and the chassis enclosure 400 are securely locked.

Referring to FIGS. 1, 4, 5, 6, 7, and 8, specifically, to assemble the crossbar 100, the side board 300, and the chassis enclosure 400, the first journal 311 disposed on the side board 300 is first embedded in the first engaging groove 120 of the crossbar 100 via the opening of the first engaging groove 120, then one end of the chassis enclosure 400 is snap-fitted in the first journal 311 via the second engaging groove 412 (in this example, the opening direction of the first engaging groove 120 is opposite to that of the second engaging groove 412); next, the chassis enclosure 400 is embedded into the accommodation cavity with the first journal 311 as the point of rotation; when the chassis enclosure 400 is embedded in the accommodation cavity, the locking element 422 is squeezed by a side surface of the crossbar 100, causing the locking element 422 to compress the elastic member 430 to be folded into the chassis enclosure 400; next, when the chassis enclosure 400 is completely embedded in the crossbar 100, the socket 130 of the crossbar 100 corresponds to the position of the locking element, so that the locking element 422, when being elastically loaded by the elastic member 430, projects out of the chassis enclosure 400 and is inserted through the through hole into the socket 130 at the inner side of the crossbar 100; in this way, one end of the chassis enclosure 400 is connected to the first journal 311 of the side board 300 via the second engaging groove 412, while the other end thereof is connected to the crossbar 100, thereby completing locked connection between the side board 300, the chassis enclosure 400, and the crossbar 100.

In this embodiment, the crossbar 100, the chassis enclosure 400, and the side board 300 are connected with each other by snap-fitting between engaging grooves and mated journals. Upon assembly, the opening portion of the engaging groove allows the chassis enclosure 400 to rotate about the first journal 311 when an end portion of the chassis enclosure 400 is snap-fitted to the outside of the first journal 311 via the second engaging groove 412; in this way, upon assembly, after the chassis enclosure 400 rotates about the first journal 311 via the second engaging groove 412 into the accommodation cavity, the second journal 110 and the mated third engaging groove 411, which are disposed between a side surface of the chassis enclosure 400 and the crossbar 100, are also snap-fitted correspondingly; meanwhile, with the locking element 422 for locking the crossbar 100, locked snap-fitting between the chassis enclosure 400, the crossbar 100, and the side board 300 are smoothly implemented. This not only facilitates assembly, but also conceals the chassis enclosure 400 into the accommodation cavity on the crossbar 100, thereby protecting the chassis enclosure while optimizing assembled structure of the product, giving a more reasonable, compact product structure.

In this embodiment, when the chassis enclosure 400 is embedded into the accommodation cavity about the first journal 311 at the joint with the side board 300 as the point of rotation, quick assembly between the crossbar 100, the chassis enclosure 400, and the side board 300 is implemented, which enhances assembly efficiency and eliminates a need of fixing members such as screws, thereby simplifying and facilitating assembly.

In this example embodiment, the elastic member 430 may be a spring or an elastic rubber, so long as it has a required elastic deformation amount and can push the locking elements out of the chassis enclosure 400 into the sockets 130 in the crossbar 100.

Figure 4:
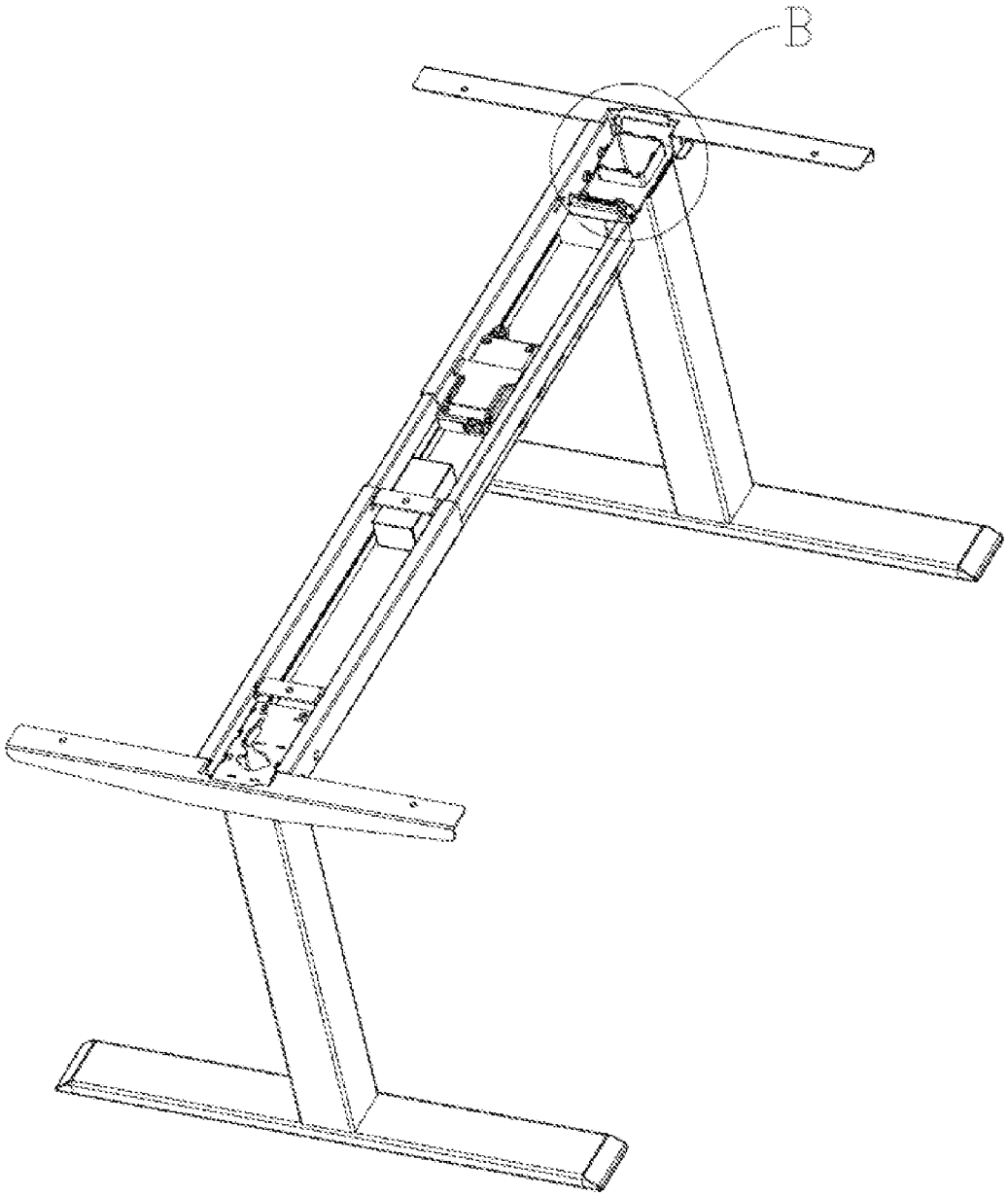
FIG. 4 is a structural schematic diagram (without showing an upper cover board) according to some embodiments of the disclosure.
Figure 5:
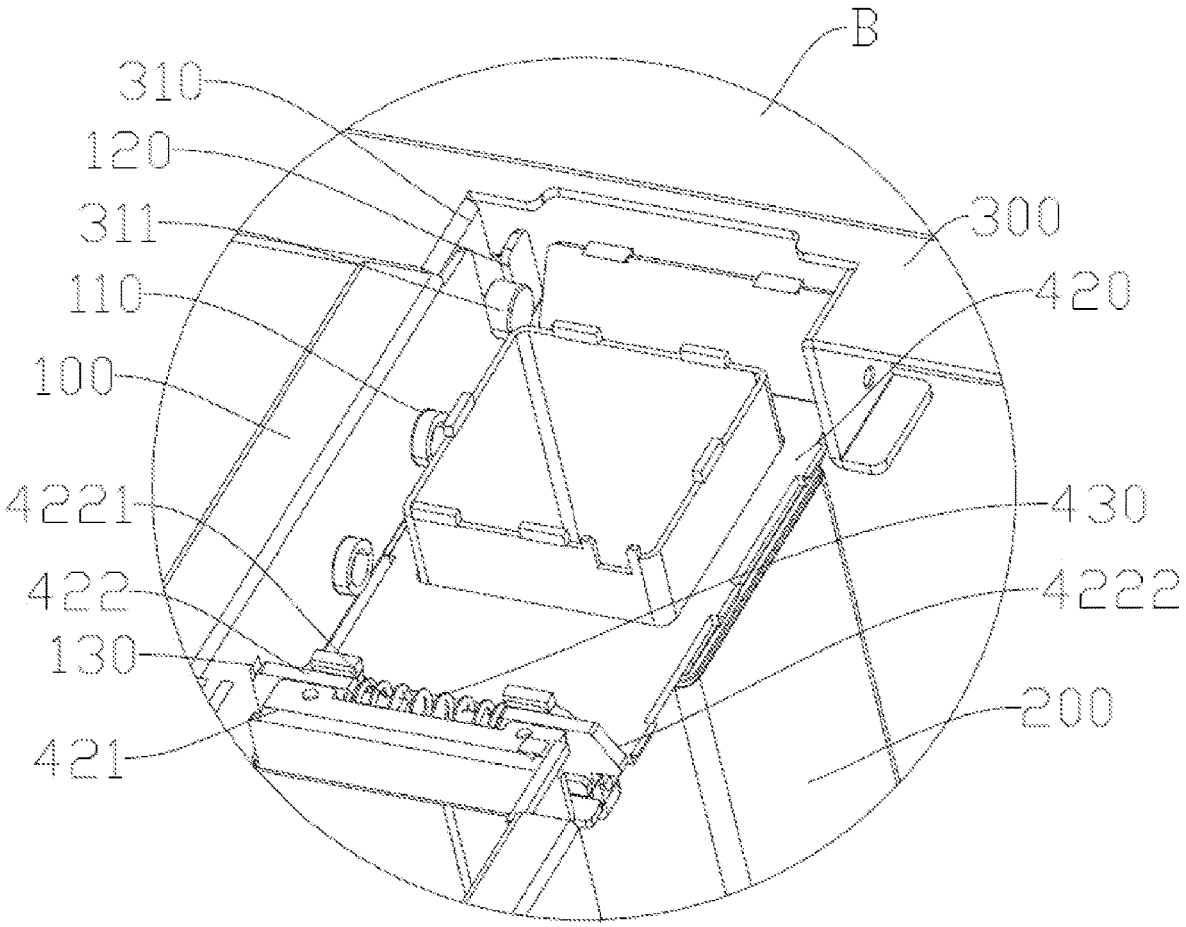
FIG. 5 is a structural schematic diagram of part B in FIG. 4 according to some embodiments of the disclosure.
Figure 6:
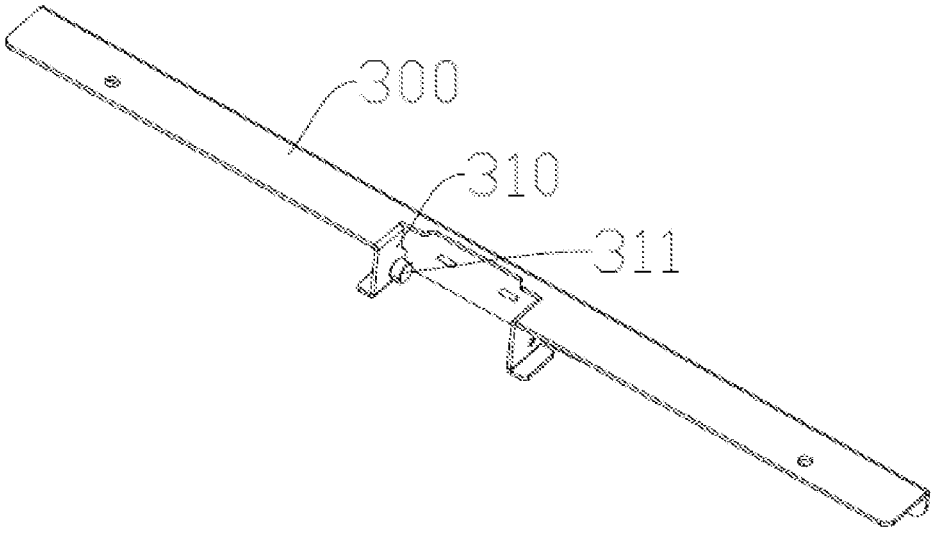
FIG. 6 is a structural schematic diagram of a side board according to some embodiments of the disclosure.
Figure 7:
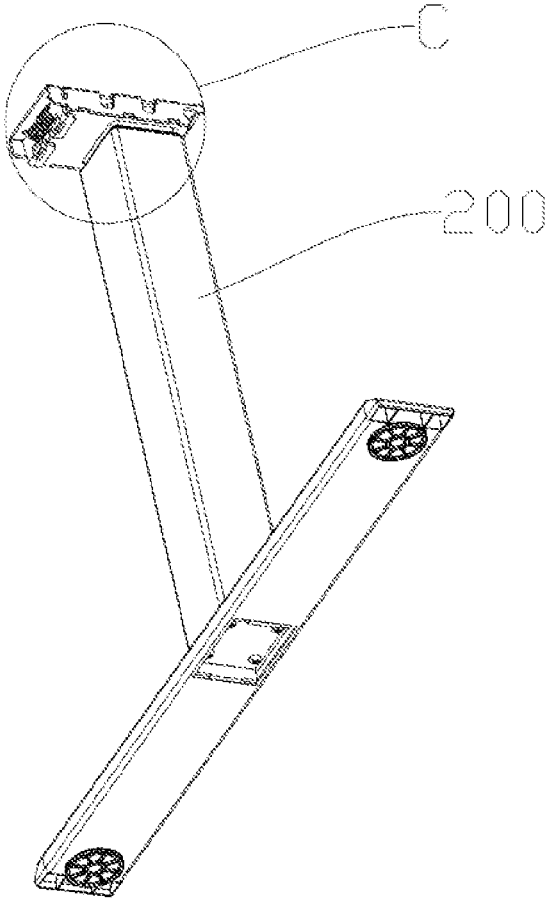
FIG. 7 is a structural schematic diagram of a chassis enclosure and a column according to some embodiments of the disclosure.
Figure 8:
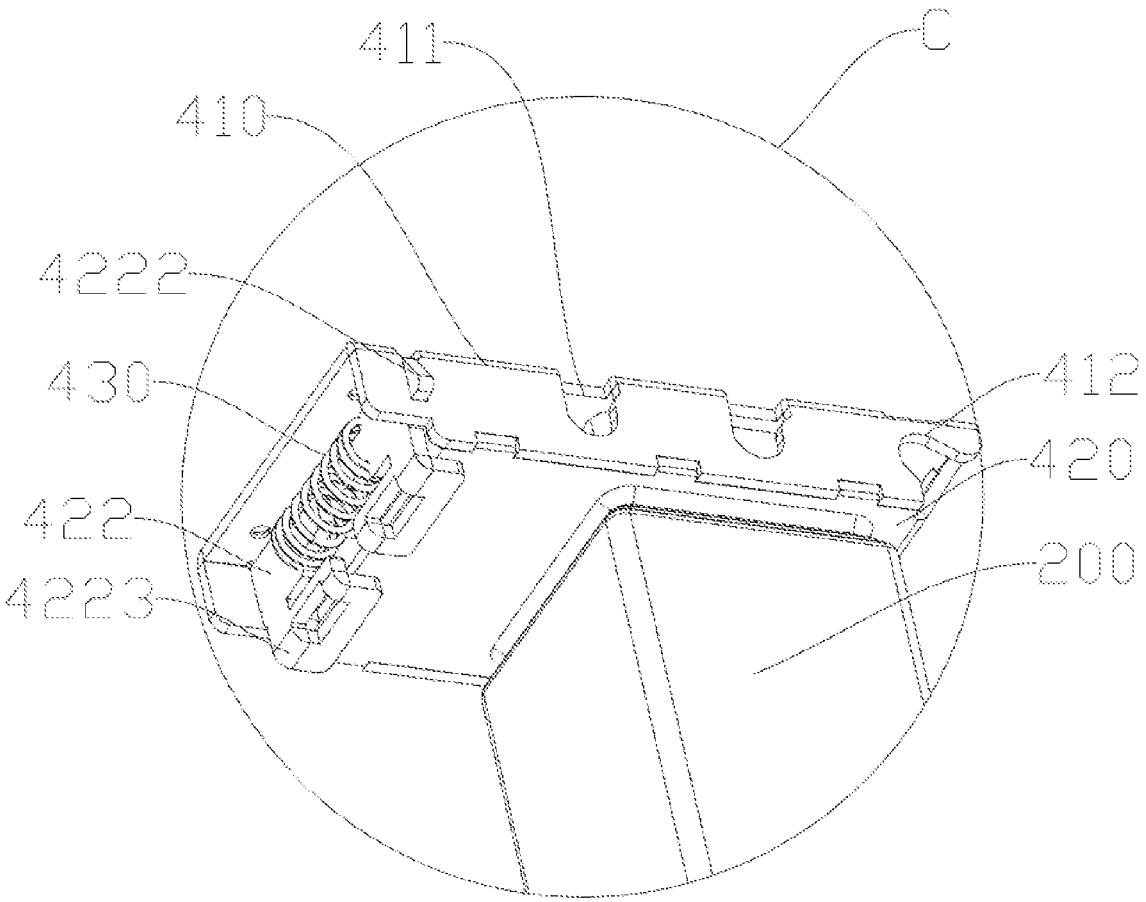
FIG. 8 is an enlarged view of the structure of part C in FIG. 7 according to some embodiments of the disclosure.

Referring to FIGS. 4 and 5, in the disclosure, the locking element 422 is of a sheet structure; one end of the locking element 422 is provided with a connecting end 4221 smaller than an inner diameter of the spring, and an insert-fitting end 4222 capable of projecting out of the chassis enclosure 400; the spring is disposed between two connecting ends 4221 and configured to apply an elastic pressure against the two connecting ends 4221 to urge the insert-fitting end 4222 of the locking element 422 to project out of the chassis enclosure 400; the front and rear ends of the locking element 422 are disposed on the lower housing 420 and each is provided with a guide rib 421, a guide groove being formed in each of the two guide ribs 421, the guide groove being configured to define a movement direction of the locking element 422 while preventing the locking element 422 from swaying during moving.

In the disclosure, referring to FIG. 5, to enable, upon embedding the chassis enclosure 400 in the accommodation cavity, the locking element 422 on the chassis enclosure 400 to be smoothly retracted into the chassis enclosure 400 when being squeezed by a side surface of the crossbar 100, a beveled wedge surface in beveled wedge-fitting with the crossbar 100 may be provided at the insert-fitting end 4222 of the locking element 422, so that when the chassis enclosure 400 is inserted in the accommodation cavity, a side edge of the crossbar 100 can squeeze against the beveled wedge surface of the locking element 422 to guide the locking element 422, after the spring is compressed to be retracted, into the chassis enclosure 400, while when the through hole on the chassis enclosure 400 is aligned with the socket on the crossbar 100, the locking element 422, under an elasticity recovery action of the elastic member, is pushed out of the chassis enclosure 400 into the socket on the crossbar 100, thereby implementing locking between the chassis enclosure 400 and the crossbar 100.

Based on the example embodiments described supra, to facilitate detachment of the locking element 422 from the socket 130 of the crossbar 100 to thereby realize separation between the chassis enclosure 400, the crossbar 100, and the side board 300, an unlocking element 4223 is integrally formed at the lower end of the locking element 422, and a lower end of the unlocking element 4223 extends outside the chassis enclosure 400; in this way, by toggling the unlocking element 4223, the locking element 422 is driven to squeeze and compress the spring to be folded into the chassis enclosure 400, thereby implementing separation of the chassis enclosure 400 from the crossbar 100.

Based on the example embodiments described supra, referring to FIGS. 2 and 3, to enhance connection stability between the chassis enclosure 400, the crossbar 100, and the side board 300 and to enhance pressure-bearing performance of the product as well as connection stability between the three parts, at least two second journals 110 are provided lengthwise along the inner side of the crossbar 100; the two horizontally arranged second journals 110 increase connection stability between the chassis enclosure 400 and the crossbar 100 via fitting between the third engaging groove 411 and the second journal 110, thereby preventing sway of the chassis enclosure 400 embedded in the accommodation cavity and enhancing stability and pressure-bearing performance of the chassis enclosure 400 in the crossbar 100.

Based on the example embodiments described supra, it may be contemplated that, the second journals 110 may be provided at the inner side of the crossbar 100, and the third engaging groove 411 may be disposed at each of the two sides of the chassis enclosure 400; alternatively, the second journals 110 may also be disposed at two sides of the chassis enclosure 400, while the third engaging groove 411 is correspondingly disposed on the inner side of the crossbar 100, which may also achieve the effects noted supra.

What have been described above are only example embodiments of the present disclosure; however, the protection scope of the present disclosure is not limited thereto. A person skilled in the art should understand that the disclosure includes, but is not limited to, the contents described in the drawings and the embodiments. Any modifications without departing from the functions and structural principles of the disclosure will be included within the scope of the claims.

I claim:

1. An electric height adjustable desk, comprising:

a frame and a column, the frame comprising a crossbar and a side board connected at each of two ends of the crossbar, an end portion of the column being provided with a chassis enclosure, and an accommodation cavity being provided on the crossbar, the chassis enclosure being at least partially embedded in the accommodation cavity, wherein a detachable first latch mechanism is provided between a side surface of the side board and the chassis enclosure, the side board being detachably connected to the crossbar via the first latch mechanism;

a detachable second latch mechanism is provided between the chassis enclosure and the crossbar;

a locking device is provided on the chassis enclosure, the locking device being locked on the crossbar to maintain a connected state between the first latch mechanism and the second latch mechanism, the second latch mechanism being disposed between the locking device and the first latch mechanism;

the first latch mechanism comprises a first journal, a first engaging groove, and a second engaging groove, the first engaging groove and the second engaging groove being snap-fitted with the first journal, respectively, the first journal being disposed on the side board, the first engaging groove being provided at one end of the crossbar, the second engaging groove being provided at one end of the chassis enclosure;

the second latch mechanism comprises a third engaging groove and a second journal fitted with the third engaging groove, either one of the second journal and the third engaging groove being provided at an inner side of the crossbar, another one of the second journal and the third engaging groove being provided at a side surface of the chassis enclosure an opening direction of the first engaging groove is opposite to an opening direction of the second engaging groove, and the opening direction of the first engaging groove is consistent with an opening direction of the third engaging groove.

2. The electric height adjustable desk according to claim 1, wherein at least two second journals are provided, a plurality of the second journals being distributed, along a length direction of the crossbar, on the side surface of the chassis enclosure or at the inner side of the crossbar.

3. The electric height adjustable desk according to claim 1, wherein the locking device comprises a locking element and an unlocking element, the locking element being movably disposed on the chassis enclosure, the crossbar being provided with a socket insert-fitted with the locking element, the locking element being movable relative to the chassis enclosure into the socket to thereby lock the chassis enclosure to the crossbar, the unlocking element being configured to bring the locking element to move so as to be detached from the socket.

4. The electric height adjustable desk according to claim 3, wherein a cavity for accommodating the locking element is provided in the chassis enclosure, an elastic member configured to push the locking element through the chassis enclosure into the socket is provided in the cavity.

5. The electric height adjustable desk according to claim 3, wherein a guide rib configured to guide the locking element to move into the socket is provided in the chassis enclosure.

6. The electric height adjustable desk according to claim 3, wherein the unlocking element and the locking element are connected, the unlocking element being partially disposed outside the chassis enclosure so that the locking element is moved by the unlocking element from outside of the chassis enclosure.

7. The electric height adjustable desk according to claim 1, wherein an end portion of the crossbar is provided with a mounting groove opened upwards, the side board having a mounting lug embeddable in the mounting groove, the first journal being disposed on the mounting lug.

* * * * *